US008970468B2

(12) United States Patent
Albrecht et al.

(10) Patent No.: US 8,970,468 B2
(45) Date of Patent: Mar. 3, 2015

(54) DYNAMIC COLOR ADJUSTMENT FOR DISPLAYS

(71) Applicant: Apple Inc., Cupertino, CA (US)

(72) Inventors: Marc Albrecht, San Francisco, CA (US); Ulrich Barnhoefer, Cupertino, CA (US); Gabriel Marcu, San Jose, CA (US); Sandro H. Pintz, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 144 days.

(21) Appl. No.: 13/683,523

(22) Filed: Nov. 21, 2012

(65) Prior Publication Data

US 2014/0139571 A1 May 22, 2014

(51) Int. Cl.
*G09G 5/02* (2006.01)

(52) U.S. Cl.
CPC ..... *G09G 5/02* (2013.01); *G09G 2320/041* (2013.01); *G09G 2320/0666* (2013.01); *G09G 2320/0693* (2013.01); *G09G 2360/144* (2013.01)
USPC ..... 345/101

(58) Field of Classification Search
CPC ..... G09G 3/365; G09G 3/361; G09G 3/22; G09G 3/2003
USPC ..... 345/101, 690, 591
See application file for complete search history.

(56) References Cited

U.S. PATENT DOCUMENTS

| | | | | |
|---|---|---|---|---|
| 5,489,918 | A | 2/1996 | Mosier | |
| 6,906,744 | B1 | 6/2005 | Hoshuyama et al. | |
| 7,859,554 | B2 | 12/2010 | Young | |
| 2006/0187232 | A1 * | 8/2006 | Kempf et al. | 345/591 |
| 2008/0036727 | A1 * | 2/2008 | Muto et al. | 345/101 |
| 2008/0284712 | A1 * | 11/2008 | Muto et al. | 345/101 |
| 2010/0123744 | A1 * | 5/2010 | Iba et al. | 345/694 |
| 2010/0226487 | A1 | 9/2010 | Harder et al. | |
| 2011/0032275 | A1 * | 2/2011 | Marcu et al. | 345/690 |
| 2012/0119670 | A1 | 5/2012 | Vinkenvleugel et al. | |

* cited by examiner

*Primary Examiner* — Dwayne Bost
*Assistant Examiner* — Chineyere Wills-Burns
(74) *Attorney, Agent, or Firm* — Treyz Law Group; Kendall P. Woodruff

(57) ABSTRACT

An electronic device may include a display and display control circuitry. The display may be calibrated to compensate for changes in display temperature. Display calibration information may be obtained during manufacturing and may be stored in the electronic device. The display calibration information may include color-specific adjustment factors configured to adjust display colors and reduce temperature-related color shifts. During operation of the display, the display control circuitry may receive input pixel values for a display pixel. The display control circuitry may also receive display temperature information from a temperature sensor in the electronic device. The display control circuitry may determine adjustment factors based on a color associated with the input pixel values and the display temperature information. The display control circuitry may apply the adjustment factors to the input pixel values to obtain adapted pixel values. The adapted pixel values may be provided to the display pixel.

22 Claims, 13 Drawing Sheets

62

| NEUTRAL (R:G:B=1:1:1) | |
|---|---|
| T1 | RGB1 |
| T2 | RGB2 |
| ⋮ | ⋮ |
| Tm | RGBm |

FIG. 10

64

| YELLOWISH (R:G:B=2:2:1) | |
|---|---|
| T1 | RGB1' |
| T2 | RGB2' |
| ⋮ | ⋮ |
| Tm | RGBm' |

FIG. 11

66

| GREENISH BLUE (R:G:B=1:2:3) | |
|---|---|
| T1 | RGB1" |
| T2 | RGB2" |
| ⋮ | ⋮ |
| Tm | RGBm" |

FIG. 12

DYNAMIC COLOR ADJUSTMENT FOR DISPLAYS

BACKGROUND

This relates generally to electronic devices with displays and, more particularly, to electronic devices with calibrated displays.

Electronic devices such as portable computers, media players, cellular telephones, set-top boxes, and other electronic equipment are often provided with displays for displaying visual information.

Displays are often capable of displaying color images. However, the color response of a display may change as the display operates. For example, changing operating conditions such as changing display temperature may affect the color response of a display. Some displays depict white as somewhat yellowish when initially powered on and cold. As the display warms, the white point of the display shifts toward a more neutral white, such as that defined by the standard illuminant, D65. Other display colors such as skin tone colors may also experience shifts within a color space as the temperature of the display changes. Similarly, other parameters of the display may shift as a function of temperature such as luminance, black level, contrast, or electro-optical transfer function, which may be referred to as the "native gamma" of the display. This set of parameters may be referred to as the color profile of the display.

The shift in the color profile due to temperature changes in the display generally causes each pixel of the display to change color until a stable operating temperature is achieved, at which point the pixel colors may likewise be stable. That is, although a pixel may be instructed to display the same color at an initial temperature and a stable operating temperature, the actual color displayed, as objectively measured by its chromaticity and luminance, may vary.

Displays are sometimes calibrated to account for temperature induced white point shifts. Conventional methods include applying temperature dependent adjustment values to input pixel values to obtain adapted input pixel values. However, the temperature dependent adjustment values are typically optimized for neutral colors such as white. Applying these temperature dependent adjustment values to non-neutral colors leads to an undesirable color shift for the non-neutral colors.

It would therefore be desirable to be able to provide improved ways of calibrating electronic devices with color displays.

SUMMARY

An electronic device may include a display and display control circuitry. The display may be calibrated during manufacturing using a calibration system. The calibration system may include calibration computing equipment coupled to a light sensor and may be used to gather display performance information from the display. The display performance information may be recorded as a function of one or more input parameters such as display temperature. Gathering display performance information may include measuring display luminance and chromaticity values.

Display performance information may be used to calculate color-specific and temperature-dependent adjustment values. For example, a table of adjustment values may be derived for each color in a number of different colors. Each table of adjustment values may include a number of different adjustment values corresponding respectively to different display temperatures. The tables of adjustment values may be stored in the electronic device.

Display control circuitry in the electronic device may use the stored adjustment values to adjust display colors in order to compensate for temperature related shifts in display colors.

The display control circuitry may receive incoming pixel values for a display pixel. The display control circuitry may also receive display temperature information from a temperature sensor in the electronic device.

The display control circuitry may determine the color associated with the incoming pixel values. This may include determining a ratio of a red pixel value to a green pixel value to a blue pixel value. The display control circuitry may determine adjustment values to apply to the incoming pixel values based on the display temperature information and the color associated with the incoming pixel values.

If the color associated with the incoming pixel values does not exactly match any of the colors for which adjustment values have been stored, methods such as a combination of Inverse Distance Weighting and Delaunay Triangulation may be used to interpolate adjustment values for the incoming pixel values.

If the color associated with the incoming pixel values matches one of the colors for which adjustment values have been stored, the stored adjustment values may be directly applied to the incoming pixel values.

The display control circuitry may apply the adjustment values to the incoming pixel values to obtain adapted pixel values. The display control circuitry may provide the adapted pixel values to the display pixel.

The display control circuitry may determine whether a color associated with incoming pixel values falls within a predetermined subset of colors. The predetermined subset of colors may, for example, be a subset of skin tone colors, a subset of grass tone colors, or a subset of sky tone colors.

If the color associated with the incoming pixel values does not fall within one of the predetermined subsets of colors, the display control circuitry may apply adjustment values of a first type to the incoming pixel values. The adjustment values of the first type may be values that compensate for temperature related white point shifts.

If the color associated with the incoming pixel values falls within one of the predetermined subsets of colors, the display control circuitry may apply adjustment values of a second type to the incoming pixel values. The adjustment values of the second type may be values that compensate for temperature related shifts in an associated one of the predetermined subsets of colors.

Further features of the invention, its nature and various advantages will be more apparent from the accompanying drawings and the following detailed description of the preferred embodiments.

BRIEF DESCRIPTION OF THE DRAWINGS

FIG. 10 is an illustrative table of color-specific adjustment values optimized for neutral colors in accordance with an embodiment of the present invention.

FIG. 11 is an illustrative table of color-specific adjustment values optimized for yellowish colors in accordance with an embodiment of the present invention.

FIG. 12 is an illustrative table of color-specific adjustment values optimized for greenish blue colors in accordance with an embodiment of the present invention.

DETAILED DESCRIPTION

Figure 1:
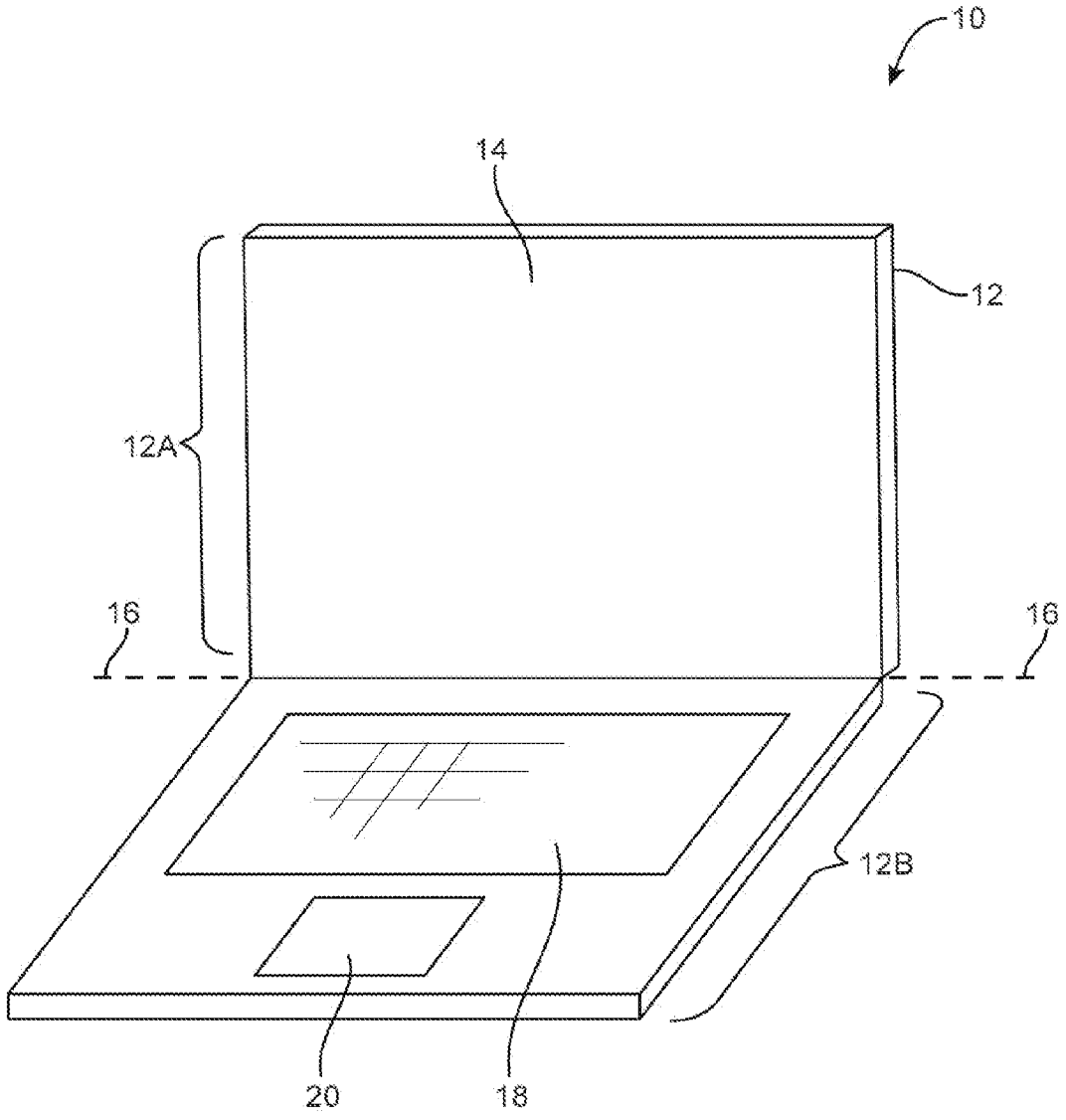
FIG. 1 is a diagram of an illustrative electronic device such as a portable computer having a calibrated display in accordance with an embodiment of the present invention.

Electronic devices such as cellular telephones, media players, computers, set-top boxes, wireless access points, and other electronic equipment may include displays. Displays may be used to present visual information and status data and/or may be used to gather user input data.

Displays may be configured to display color images. For example, displays may include color display pixels configured to create colored light. Individual pixels of a display may receive a red, green, and blue value that together define the color to be created by the pixel. These red, green, and blue values are referred to herein in the aggregate as an "RGB value," as understood to those of ordinary skill in the art.

If care is not taken, display colors may shift within a color space as the temperature of a display varies. To account for changes in display operating temperature, display colors may be adjusted using adjustment values. For example, an adjustment value may be applied to an input RGB value to obtain an adapted RGB value that accounts for changes in display temperature. The adjustment value may be based on the color associated with the RGB value and on the display temperature. The adjustment value may be found in a look-up table or may be computed by interpolating from the values found in the table. The adjustment value may be applied, depending on the type of display, to an RGB value that may be supplied to a display pixel or to the gain of the red channel, green channel, and blue channel to adjust the colors of the display.

Display colors may be corrected as the display warms up and changes temperature. Display performance information such as luminance and chromaticity values may be recorded for different RGB input values and for every temperature in a set of temperatures. The display may produce a color range that may be referred to herein as the "display color gamut." The display color gamut may determined based on the recorded data using either a matrix multiplication and gamma correction based model (called the matrix model) or a look-up table and optional interpolation based model, called the "LUT model." Generally, a color model is a way of representing the correspondence between colors as measured by an instrument on the display and the RGB values that produce these colors on the display. The table based model may be created, for example, by empirically measuring luminance and chromaticity for a variety of pixel colors expressed in RGB values and comparing them to desired or perceived luminance and chromaticity values.

These desired values generally correspond to the luminance and chromaticity that are set as the luminance and chromaticity target values for that display. The target may correspond to the luminance and chromaticity of the displayed color when the electronic display has achieved its stable operating temperature. Alternatively, the target may correspond to a different set of luminance and chromaticity values. For example, the target values may be those recommended by a certain standard or selected by the user according to particular needs. As another example, a fixed luminance and D65 reference white point may be used as a target for white. Also, the target may be specified by a luminance and chromaticity value that varies according to a precise function selected by the user. In short, the target luminance and chromaticity for a given color can be an arbitrary set. At various temperature values, certain color models may be more suitable than others for coding the colors produced by that device. There may be multiple color models such that each individual color model corresponds to a specific temperature. Thus, as the temperature of the display increases, the color model of the display (or its component pixels) may change.

A target state of the display may be defined as a chromaticity value and a luminance value of the display. For a specific temperature and color for which the parameters of the color model have been measured, the adjustment values for each R, G, and B components may be computed using the color models and the target luminance and chromaticity value. The RGB adjustment values may be organized into tables such that each line in a given table provides the RGB adjustment values corresponding to specific temperature and a specific color. For an arbitrary color that is not included in the set of tables, the corresponding RGB adjustment values may be computed by interpolating the RGB adjustment values among two or more tables. For an arbitrary temperature value that is not included in a given table, the corresponding RGB adjustment values may be computed by interpolating the RGB adjustment values in that table. These tables may sometimes be referred to herein as RGB adjustment value tables.

An illustrative electronic device of the type that may be provided with a calibrated display is shown in FIG. 1. Electronic device 10 may be a computer such as a computer that is integrated into a display such as a computer monitor, a laptop computer, a tablet computer, a somewhat smaller portable device such as a wrist-watch device, pendant device, or other wearable or miniature device, a cellular telephone, a media player, a tablet computer, a gaming device, a navigation device, a computer monitor, a television, or other electronic equipment.

As shown in FIG. 1, device 10 may include a display such as display 14. Display 14 may be a touch screen that incorporates capacitive touch electrodes or other touch sensor components or may be a display that is not touch-sensitive. Display 14 may include image pixels formed from light-emitting diodes (LEDs), organic light-emitting diodes (OLEDs), plasma cells, electrophoretic display elements, electrowetting display elements, liquid crystal display (LCD) components, or other suitable image pixel structures. Arrangements in which display 14 is formed using liquid crystal display pixels are sometimes described herein as an example. This is, however, merely illustrative. Any suitable type of display technology may be used in forming display 14 if desired.

Device 10 may have a housing such as housing 12. Housing 12, which may sometimes be referred to as a case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.).

As shown in FIG. 1, housing 12 may have multiple parts. For example, housing 12 may have upper portion 12A and lower portion 12B. Upper portion 12A may be coupled to lower portion 12B using a hinge that allows portion 12A to rotate about rotational axis 16 relative to portion 12B. A keyboard such as keyboard 18 and a touch pad such as touch pad 20 may be mounted in housing portion 12B.

Figure 2:
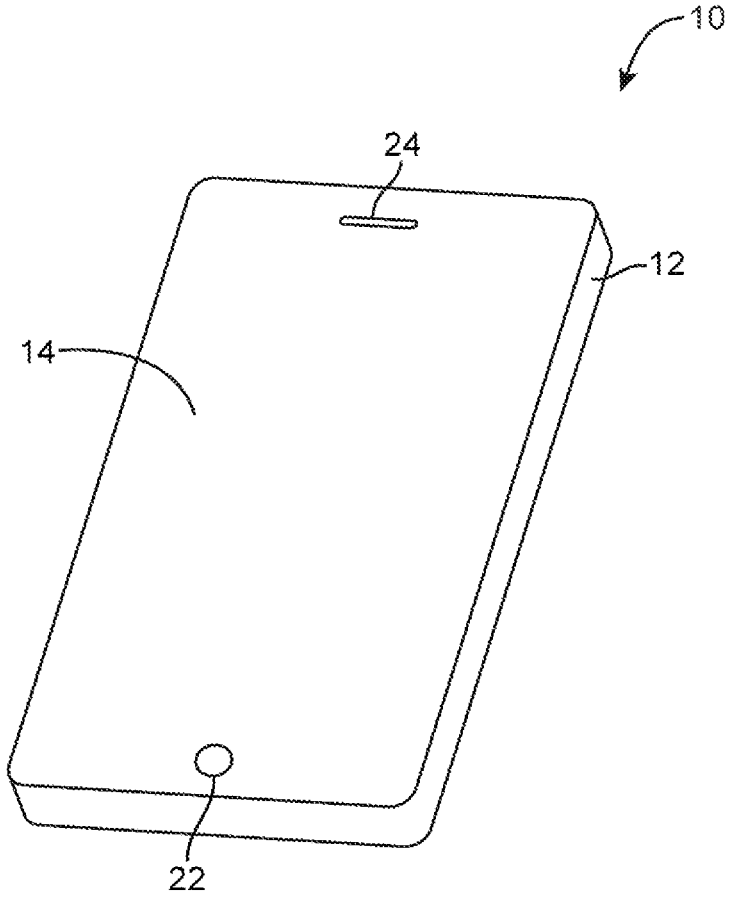
FIG. 2 is a diagram of an illustrative electronic device such as a cellular telephone or other handheld device having a calibrated display in accordance with an embodiment of the present invention.

In the example of FIG. 2, device 10 has been implemented using a housing that is sufficiently small to fit within a user's hand (e.g., device 10 of FIG. 2 may be a handheld electronic device such as a cellular telephone). As show in FIG. 2, device 10 may include a display such as display 14 mounted on the front of housing 12. Display 14 may be substantially filled with active display pixels or may have an active portion and an inactive portion. Display 14 may have openings (e.g., openings in the inactive or active portions of display 14) such as an opening to accommodate button 22 and an opening to accommodate speaker port 24.

Figure 3:
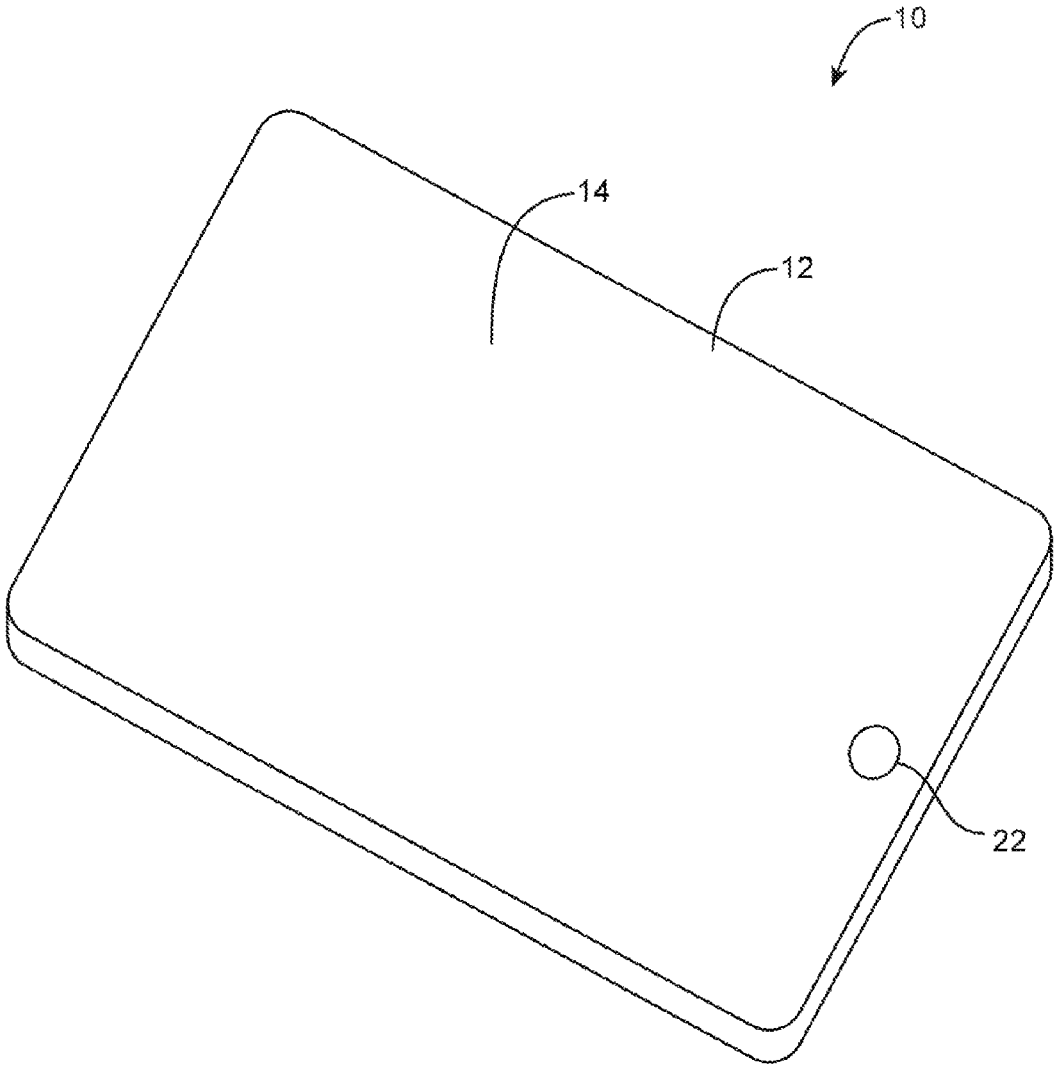
FIG. 3 is a diagram of an illustrative electronic device such as a tablet computer having a calibrated display in accordance with an embodiment of the present invention.

FIG. 3 is a perspective view of electronic device 10 in a configuration in which electronic device 10 has been implemented in the form of a tablet computer. As shown in FIG. 3, display 14 may be mounted on the upper (front) surface of housing 12. An opening may be formed in display 14 to accommodate button 22.

Figure 4:
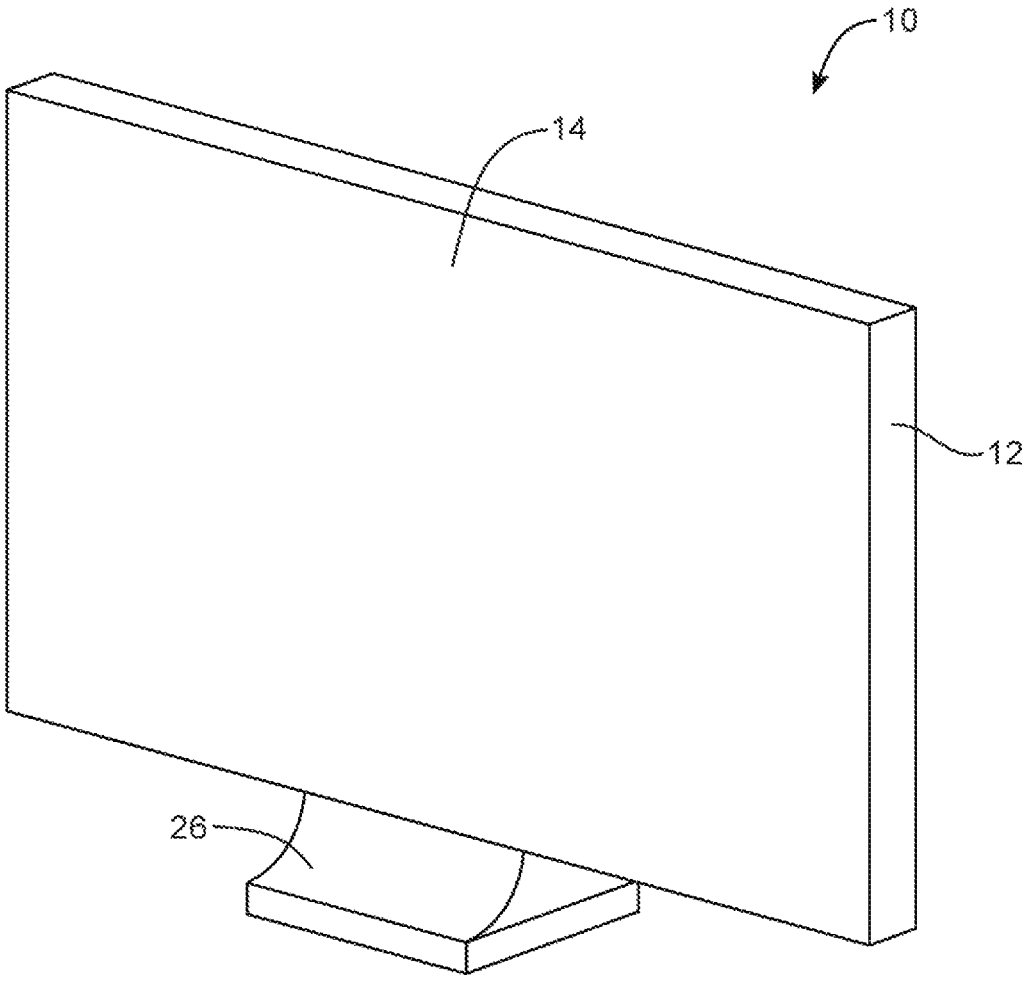
FIG. 4 is a diagram of an illustrative electronic device such as a computer monitor with a built-in computer having a calibrated display in accordance with an embodiment of the present invention.

FIG. 4 is a perspective view of electronic device 10 in a configuration in which electronic device 10 has been implemented in the form of a computer integrated into a computer monitor. As shown in FIG. 4, display 14 may be mounted on a front surface of housing 12. Stand 26 may be used to support housing 12.

Figure 5:
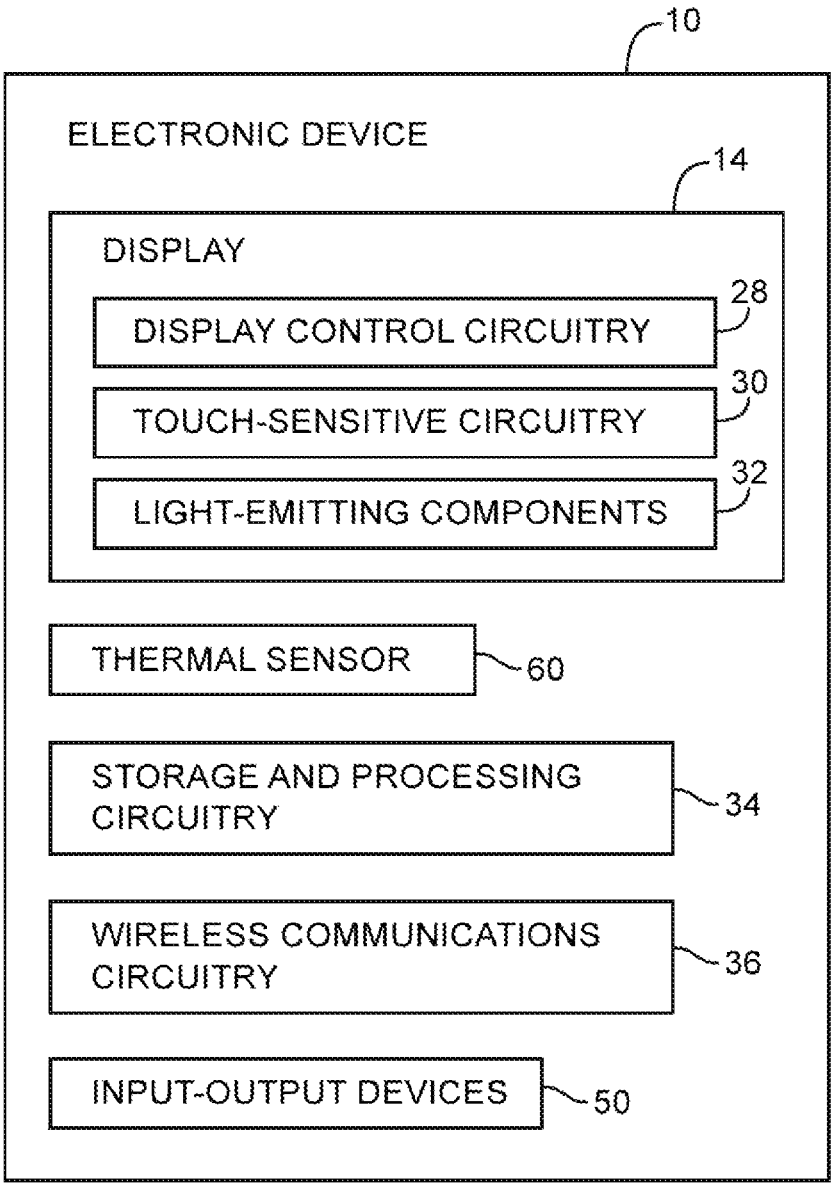
FIG. 5 is a schematic diagram of an illustrative electronic device having a calibrated display in accordance with an embodiment of the present invention.

A schematic diagram of electronic device 10 is shown in FIG. 5. As shown in FIG. 5, electronic device 10 may include a display such as display 14. Display 14 may include light-emitting components 32, touch-sensitive circuitry 30, display control circuitry 28 for operating light-emitting components 32, and other display components.

Light-emitting components 32 may include display pixels formed from reflective components, liquid crystal display (LCD) components, organic light-emitting diode (OLED) components, or other suitable display pixel structures. To provide display 14 with the ability to display color images, light-emitting components 32 may include display pixels having color filter elements. Each color filter element may be used to impart color to the light associated with a respective display pixel in the pixel array of display 14.

Display touch circuitry such as touch-sensitive circuitry 30 may include capacitive touch electrodes (e.g., indium tin oxide electrodes or other suitable transparent electrodes) or other touch sensor components (e.g., resistive touch technologies, acoustic touch technologies, touch sensor arrangements using light sensors, force sensors, etc.). Display 14 may be a touch screen that incorporates display touch circuitry 30 or may be a display that is not touch-sensitive.

Display control circuitry 28 may include a graphics controller (sometimes referred to as a video card or video adapter) that may be used to provide video data and control signals to display 14. Video data may include text, graphics, images, moving video content, or other content to be presented on display 14.

Display control circuitry 28 may also include display driver circuitry. Display driver circuitry in circuitry 28 may be implemented using one or more integrated circuits (ICs) and may sometimes be referred to as a driver IC, display driver integrated circuit, or display driver. Display driver circuitry may include, for example, timing controller (TCON) circuitry such as a TCON integrated circuit. If desired, display driver circuitry may be mounted on an edge of a thin-film-transistor substrate layer in display 14 (as an example). Display control circuitry 28 may be coupled to additional circuitry in device 10 such as storage and processing circuitry 34.

Device 10 may include a thermal sensor such as thermal sensor 60. Thermal sensor 60 may be an internal sensor in device 10 configured to gather temperature data from device 10. Thermal sensor 60 may be used to measure display temperature, display cover glass temperature (e.g., the temperature associated with a cover glass layer that covers display 14), backlight temperature (e.g., a the temperature associated with light-emitting diodes that provide backlight for display 14), internal component temperature (e.g., the temperature associated with an internal component in device 10 such as a central processing unit (CPU) or other component), etc. Temperature information gathered by sensor 60 may sometimes be referred to herein as "display temperature" or "device temperature."

Control circuitry such as storage and processing circuitry 34 in device 10 may include microprocessors, microcontrollers, digital signal processor integrated circuits, application-specific integrated circuits, and other processing circuitry. Volatile and non-volatile memory circuits such as random-access memory, read-only memory, hard disk drive storage, solid state drives, and other storage circuitry may also be included in circuitry 34. Display calibration information may be stored using circuitry 34 or may be stored using display control circuitry 28 or other circuitry associated with display 14.

Circuitry 34 may use wireless communications circuitry 36 and/or input-output devices 50 to obtain user input and to provide output to a user. Input-output devices 50 may include speakers, microphones, sensors, buttons, keyboards, displays, touch sensors, and other components for receiving input and supplying output. Wireless communications circuitry 36 may include wireless local area network transceiver circuitry, cellular telephone network transceiver circuitry, and other components for wireless communication.

Display calibration information such as color-specific and temperature-specific adjustment values may be loaded onto device 10 during manufacturing. The stored adjustment values may be used to adjust display colors in order to compensate for changes in display temperature. Adjustment values may be stored in any suitable location in electronic device 10. For example, adjustment values may be stored in storage and processing circuitry 34 or in display control circuitry 28.

In one suitable embodiment, a display TCON integrated circuit in circuitry 28 may receive input RGB values from storage and processing circuitry 34 and may receive display temperature information from thermal sensor 60. Based on the input RGB values and the temperature information, the TCON integrated circuit may determine a color-specific and temperature-specific adjustment value for each input RGB value. The TCON integrated circuit may apply the adjustment values to either the input RGB values or to the gain control of the RGB channels. The adjustment values may change the display colors such that the display colors appear as the target color.

Figure 6:
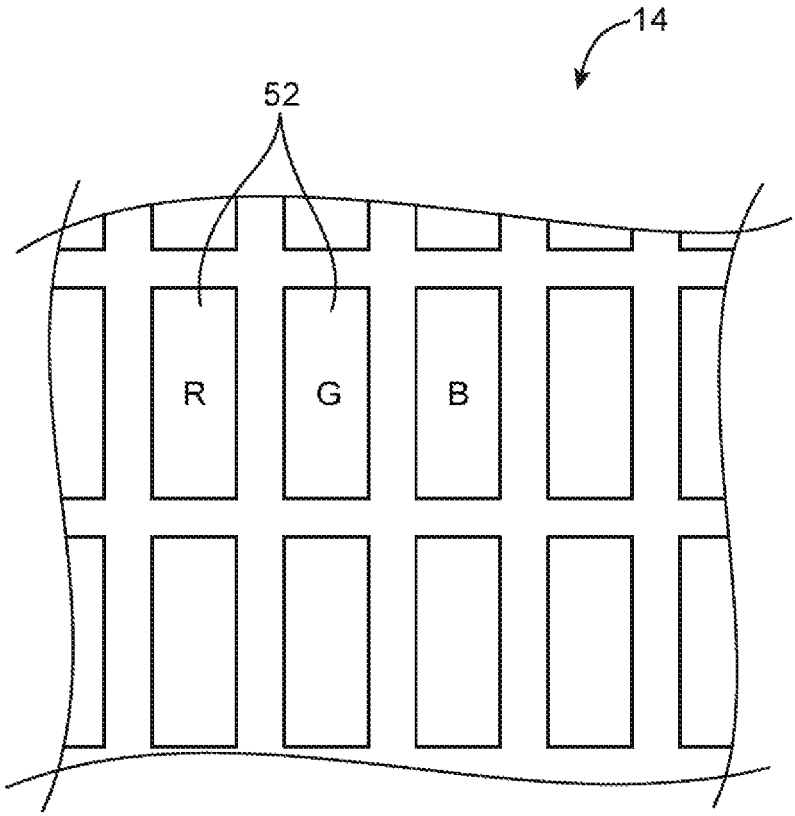
FIG. 6 is a diagram of a portion of an illustrative display showing how colored display pixels may be arranged in rows and columns in accordance with an embodiment of the present invention.

A portion of an illustrative array of display pixels that may be used in display 14 is shown in FIG. 6. As shown in FIG. 6, display 14 may have a pixel array with rows and columns of pixels such as display pixels 52. There may be tens, hundreds, or thousands of rows and columns of display pixels 52. Each pixel 52 may, if desired, be a color pixel such as a red (R) pixel, a green (G) pixel, a blue (B) pixel or a pixel of another color. Red pixels R, for example, may include a red color filter element over a light generating element (e.g., a liquid crystal pixel element or an OLED pixel element) that absorbs and/or reflects non-red light while passing red light. This is, however, merely illustrative. Pixels 52 may include any suitable structures for generating light of a given color.

Pixels 52 may include pixels of any suitable color. For example, pixels 52 may include a pattern of cyan, magenta, and yellow pixels, or may include any other suitable pattern of colors. Arrangements in which pixels 52 include a pattern of red, green, and blue pixels is sometimes described herein as an example.

Display control circuitry 28 (FIG. 5) such as a display driver integrated circuit and, if desired, associated thin-film transistor circuitry formed on a display substrate layer may be used to produce signals such as data signals and gate line signals (e.g., on data lines and gate lines respectively in display 14) for operating pixels 52 (e.g., turning pixels 52 on and/or off and/or adjusting the intensity of pixels 52). During operation, display control circuitry 28 may control the values of the data signals and gate signals to control the light intensity associated with each of the display pixels and to thereby display images on display 14.

Display control circuitry 28 may be used to convert input RGB values (sometimes referred to as digital display control values) for each display pixel 52 into analog display signals for controlling the brightness of each pixel. Control circuitry such as storage and processing circuitry 34 may provide input RGB values (commonly integers with values ranging from 0 to 255) corresponding to the desired pixel intensity of each pixel to display control circuitry 28. For example, a digital display control value of 0 may result in an "off" pixel, whereas a digital display control value of 255 may result in a pixel operating at a maximum available power.

It should be appreciated that these are examples of 24-bit color in which each color channel has eight bits dedicated to it. Alternative embodiments may employ greater or fewer bits per color channel. For example, display 14 may support 18-bit color in which each color has six bits dedicated to it. With this type of configuration, input RGB values may be a set of integers ranging from 0 to 64. Arrangements in which display 14 supports 24-bit color are sometimes described herein as an example.

Display control circuitry 28 may be used to concurrently operate pixels 52 of different colors in order to generate light having a color that is a mixture of, for example, primary colors red, green, and blue. As examples, operating red pixels R and blue pixels B at equal intensities may produce light that appears violet, operating red pixels R and green pixels G at equal intensities may generate light that appears yellow, operating red pixels R and green pixels G at maximum intensity while operating blue pixels B at half of maximum intensity may generate light that appears "yellowish," operating red pixels R, green pixels G, and blue pixels B simultaneously at maximum intensity may generate light that appears white, etc.

However, due to variations in display temperature, some internal parameters of the display may change, which may in turn affect the luminance and the chromaticity of the displayed color, even if the RGB input signal is not changed. For example, displayed colors may vary with temperature.

Figure 7:
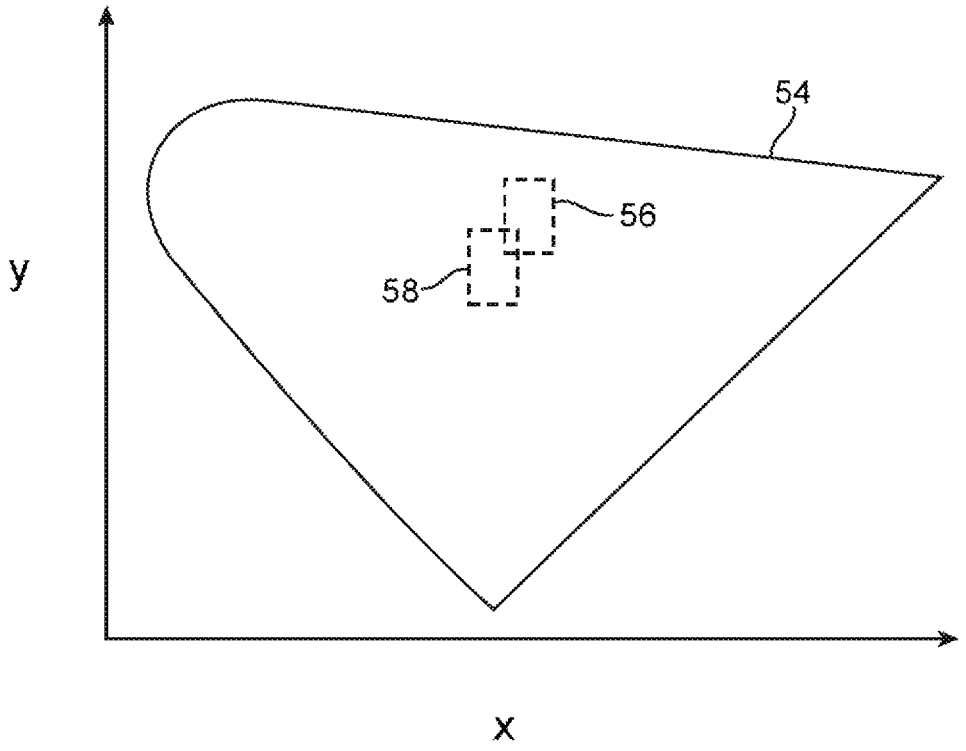
FIG. 7 is a chromaticity diagram showing how changes in display temperature may cause colors to shift within a color space.

A chromaticity diagram illustrating this type of temperature induced color shift is shown in FIG. 7. The chromaticity diagram of FIG. 7 illustrates a two-dimensional projection of a three-dimensional color space. The color generated by a display such as display 14 may be represented by chromaticity values x and y. The chromaticity values may be computed by transforming, for example, three color intensities (e.g., intensities of colored light emitted by a display) such as intensities of red, green, and blue light into three tristimulus values X, Y, and Z and normalizing the first two tristimulus values X and Y (e.g., by computing $x=X/(X+Y+Z)$ and $y=Y/(X+Y+Z)$ to obtain normalized x and y values). Transforming color intensities into tristimulus values may be performed using transformations defined by the International Commission on Illumination (CIE) or using any other suitable color transformation for computing tristimulus values.

Any color generated by a display such as display 14 may therefore be represented by a point (e.g., by chromaticity values x and y) on a chromaticity diagram such as the diagram shown in FIG. 7. Bounded region 54 of FIG. 7 represents the limits of visible light that may be perceived by humans (i.e., the total available color space). The colors that may be generated by a display are contained within a subregion of bounded region 54.

Changing display temperatures may have a noticeable impact on colors being displayed on the display. At an initial power-on state, a display may have an initial white point that lies within bounded region 56. The initial white point of the display within bounded region 56 may appear on the display as a yellowish color. As time passes, the physical display temperature may increase to a stable value. The increase in display temperature may induce a corresponding change in the display white point. For example, as the display warms up to a stable operating temperature, the display white point may shift from bounded region 56 to bounded region 58. A white point that lies within bounded region 58 may appear accurately rendered (e.g., may appear as a neutral white). If a display continues to warm up beyond a stable operating temperature, the display white point may appear slightly blue. It should be noted that the actual objective display white point may shift from region 56 to region 58 even when the RGB input values do not change. Other colors may experience a similar shift within bounded region 54 as a result of changing display temperature.

Displays are sometimes calibrated to compensate for temperature induced white point shifts. Conventional methods involve applying adjustment values (adjustment values that are optimized for white point correction) to RGB input values based on the device temperature. When these white-point-optimized adjustment values are applied to other colors, the colors often experience undesirable color shifts as the display temperature varies. For example, when white-point-optimized adjustment values are applied to skin tone colors, the skin tone colors appear bluish at higher display temperatures.

To overcome this type of temperature induced color distortion, adjustment values may be derived for specific colors. Rather than applying white-point-optimized adjustment values to all colors, a set of color-specific adjustment values may be derived for any desired color. For example, a set of adjustment values may be derived for yellowish green, a set of adjustment values may be derived for bluish red, a set of adjustment values may be derived for magenta, etc. As another example, sets of adjustment values may be derived for high-importance colors such as skin tone colors, grass tone colors, and sky tone colors.

Each set of color-specific adjustment factors may be used to adjust RGB input values to compensate for temperature changes. The color-specific adjustment values may be used to ensure that a given display color remains at the "target color" even as the display temperature changes. A target color may refer to a display color with a desired luminance and chromaticity.

Figure 8:
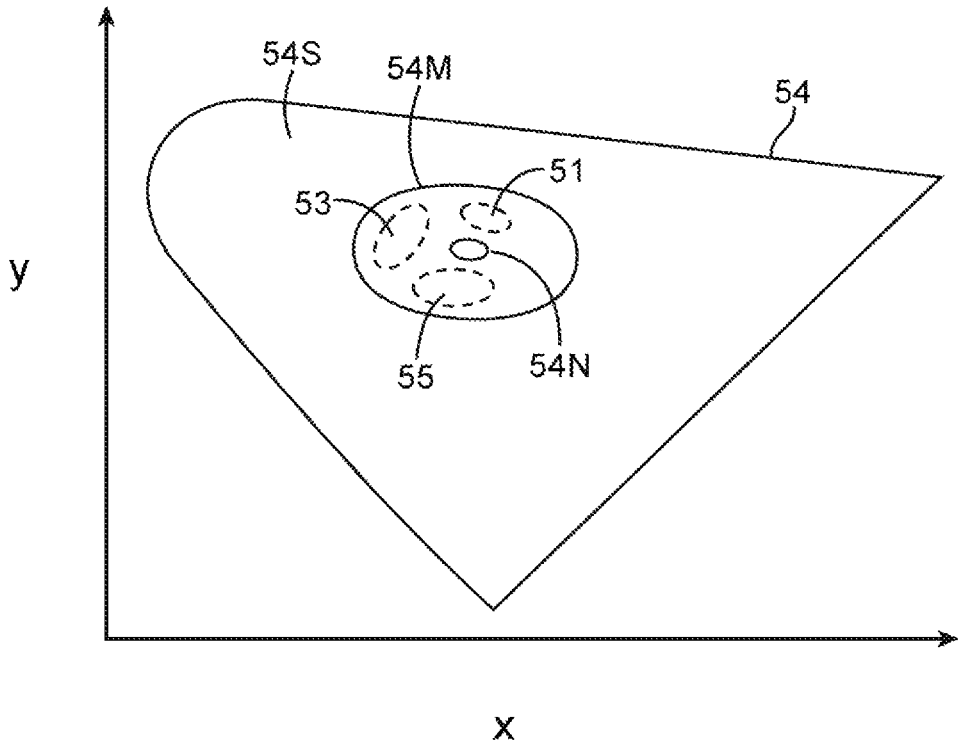
FIG. 8 is a chromaticity diagram showing illustrative colors for which tables of adjustment values may be calculated in accordance with an embodiment of the present invention.

A chromaticity diagram showing illustrative colors for which adjustment values may be derived is shown in FIG. 8. Saturated colors may be included in a subregion such as subregion 54S of bounded region 54. Subregion 54S may include saturated primary colors (e.g., saturated red, saturated green, and saturated blue) and saturated secondary colors (e.g., saturated cyan, saturated magenta, and saturated yellow). Subregion 54N may include neutral colors. Neutral colors may include, for example, colors having equal intensities of red, green, and blue. Colors such as white and gray (e.g., different shades of gray) may be included in region 54N.

A third subregion such as subregion 54M may include mid-tone colors. Mid-tone colors in subregion 54M may lie between the saturated colors of region 54S and the neutral colors of region 54N. The human eye may be more sensitive to color shifts in mid-tone colors in a display than to color shifts in saturated colors. If desired, color-specific adjustment values may be derived for a set of representative colors that lie in regions 50M and 50N to compensate for temperature induced color shifts in these regions of the color space. In general, color-specific adjustment values may be derived for any suitable color or set of colors. Choosing a set of colors that lie in region 50M and/or 50N is merely illustrative.

If desired, color-specific adjustment values may be derived for predetermined subsets of colors that fall within discrete subregions of region 54 such as subregions 51, 53, and 55. Subregions 51, 53, and 55 may be regions of the color space for which maintaining display color integrity is of particular importance. For example, subregion 51 may include colors corresponding to different skin tones, subregion 53 may include colors corresponding to different grass tones, and subregion 55 may include colors corresponding to different sky tones (as examples). The human eye may be more sensitive to color shifts in these regions than in other regions of the color space. Additionally, color integrity in these regions may be of particular importance to a user, as a display such as display 14 may often be used to display images that include skin tones, grass tones, sky tones, and other vital colors. Colors that fall in these predetermined subregions of the color space such as regions 51, 53, and 55 may sometimes be referred to as "high-importance" or "high-value" colors.

High-importance colors are not limited to regions 51, 53, and 55. In general, any suitable subregion of a color space may be defined as a region of high-importance colors. The examples of skin, grass, and sky tone colors are merely illustrative.

Figure 9:
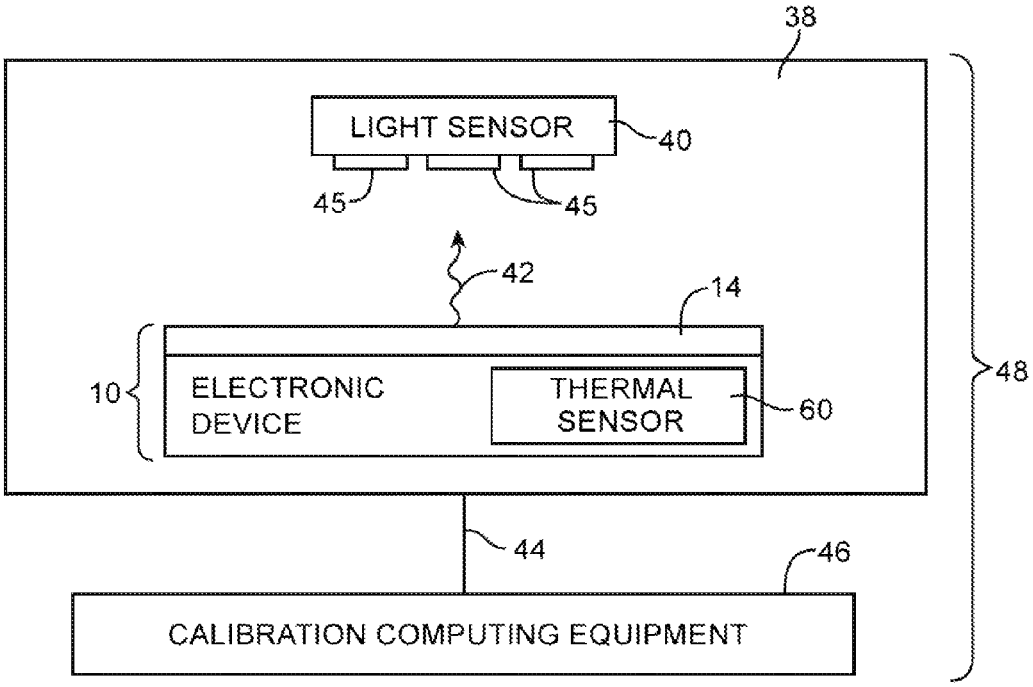
FIG. 9 is a diagram of an illustrative calibration system for performing display calibration including calibration computing equipment and a test chamber having a light sensor in accordance with an embodiment of the present invention.

FIG. 9 is a diagram of an illustrative calibration system that may be used to perform temperature adaptive display calibration for a display such as display 14 of device 10. As shown in FIG. 9, calibration system 48 may include calibration computing equipment 46 that is coupled to test apparatus such as test chamber 38. Calibration computing equipment 46 may include one or more computers, one or more databases, one or more displays, one or more technician interface devices (e.g., keyboards, touch-screens, joysticks, buttons, switches, etc.) for technician control of calibration computing equipment 46, communications components or other suitable calibration computing equipment.

Calibration computing equipment 46 may be coupled to test chamber 38 using a wired or wireless communications path such as path 44.

Test chamber 38 may include a light sensor such as light sensor 40. Light sensor 40 may include one or more light-sensitive components such as light-sensitive components 45 for gathering display light 42 emitted by display 14 during calibration operations. Light-sensitive components 45 may include, for example, colorimetric light-sensitive components and/or spectrophotometric light-sensitive components that are configured to gather colored light from display 14.

Light sensor 40 may, for example, be a colorimeter having one or more light-sensitive components 45 corresponding to each set of colored pixels in display 14. For example, a display having red, green, and blue display pixels may be calibrated using a light sensor having corresponding red, green, and blue light-sensitive components 45. This is, however, merely illustrative. A display may include display pixels for emitting colors other than red, green, and blue, and light sensor 40 may include light-sensitive components 45 sensitive to colors other than red, green, and blue, may include white light sensors, or may include spectroscopic sensors.

Test chamber 38 may, if desired, be a light-tight chamber that prevents outside light (e.g., ambient light in a testing facility) from reaching light sensor 40 during calibration operations.

During calibration operations, calibration computing equipment 46 may gather information from device 10 such as temperature information and display performance information. Calibration computing equipment 46 may use the temperature information and display performance information gathered from device 10 to generate temperature adaptive display calibration parameters for device 10.

Temperature information may be gathered from device 10 using thermal sensor 60. Thermal sensor 60 may be an internal sensor in device 10 (as shown in FIG. 9) or may be an external sensor such as an infrared thermal gun or other suitable type of temperature sensor. Thermal sensor 60 may be used to measure any suitable temperature associated with device 10 (e.g., display temperature, display cover glass temperature, backlight temperature, internal component temperature, etc.).

Temperature information gathered by thermal sensor 60 and display performance information gathered by light sensor 40 may be provided to calibration computing equipment 46 over path 44. Display performance information may include measured luminance and chromaticity values. For example, luminance (Y) and chromaticity (x,y) of light emitted by display 14 may be measured for a number of different colors (e.g., a number of different input RGB values). These measurements may be repeated for each color at a number of different temperatures.

During calibration operations, device 10 may be placed into test chamber 38 (e.g., by a technician or by a robotic member). Calibration computing equipment 46 may be used to operate device 10 and light sensor 40 during calibration operations. For example, calibration computing equipment 46 may issue a command (e.g., by transmitting a signal over path 44) to device 10 to operate some or all pixels of display 14. While device 10 is operating the pixels of display 14, calibration computing equipment 46 may operate light sensor 40 to gather display performance information from display 14 corresponding to the light 42 emitted by display 14. When it is desired to read out one or more temperatures associated with device 10, calibration computing equipment 46 may issue a command to device 10 to supply a temperature reading from thermal sensor 60 to calibration computing equipment 46 over path 44. In configurations where thermal sensor 60 is separate from device 10, calibration computing equipment 46 may, if desired, request a temperature reading directly from sensor 60.

Calibration computing equipment 46 may determine a set of color-specific adjustment values for each color in a set of predetermined colors. The adjustment value may include three values: an adjustment value for the red channel, an adjustment value for the green channel, and an adjustment value for the blue channel. For explanatory purposes, although an adjustment value may include three values, it may sometimes be referred to herein as "adjustment values." Additionally, the terms "RGB channel gain" and "input RGB values" may sometimes be referred to herein as "RGB values."

Each set of adjustment values may be stored in an RGB adjustment value table. The RGB adjustment value tables may be stored in device 10. During operation of display 14, the color-specific adjustment values may be applied to the RGB values so that the displayed colors each appear as the associated target color even though the display may be at different temperatures.

Adjustment values may be derived based on display performance information gathered during calibration operations. For example, calibration computing equipment 46 of FIG. 9 may determine which RGB input values produce a given target color at a given temperature. The RGB values that produce a given target color at a number of different temperatures may be stored in an RGB table such as RGB table 62 of FIG. 10, RGB table 64 of FIG. 11, and RGB table 66 of FIG. 12. RGB tables of this type may be used to determine a set of adjustment values for any desired target color.

Table 62 of FIG. 10 may be used to determine adjustment values optimized for neutral colors such as white and different shades of gray. Neutral colors may be defined by an R:G:B ratio of 1:1:1 (i.e., equal intensities of red, green, and blue light). As shown in FIG. 10, table 62 includes RGB values RGB1 through RGBm, where RGB1 through RGBm are the RGB values that may produce a neutral color corresponding to the target neutral color (e.g., the target white point) at the temperature T1 through Tm, respectively. The RGB1 through RGBm values may be used to compute the adjustment values R1 through Rm for the red component, G1 through Gm for the green component, and B1 through Bm for the blue component for the temperature T1 through Tm, respectively.

Table 64 of FIG. 11 may be used to determine adjustment values optimized for yellowish colors. Yellowish colors may be defined by an R:G:B ratio of 2:2:1 (i.e., red and green light each have twice the intensity of blue light). As shown in FIG. 11, table 64 includes RGB values RGB1' through RGBm', where RGB1' through RGBm' are the RGB values that may produce a yellowish color corresponding to the target yellowish color at the temperature T1 through Tm, respectively. The RGB1' through RGBm' values may be used to compute the adjustment values R1' through Rm' for the red component, G1' through Gm' for the green component, and B1' through Bm' for the blue component for the temperature T1 through Tm, respectively.

Table 66 of FIG. 12 may be used to determine adjustment values optimized for greenish blue colors. Greenish blue colors may be defined by an R:G:B ratio of 1:2:3 (i.e., green light has twice the intensity of red light, and blue light has three times the intensity of red light). As shown in FIG. 12, table 66 includes RGB values RGB1" through RGBm", where RGB1" through RGBm" are the RGB values that may produce a greenish blue color corresponding to the target greenish blue color at the temperature T1 through Tm, respectively. The RGB1" through RGBm" values may be used to compute the adjustment values R1" through Rm" for the red component, G1" through Gm" for the green component, and B1" through Bm" for the blue component for the temperature T1 through Tm, respectively.

Each adjustment value may correspond to a single temperature and may be indexed in the RGB adjustment value table by the corresponding temperature. The adjustment values may be determined for each RGB channel at a specific temperature. The adjustment value for an arbitrary temperature T may be computed by using the ratio:

$$R_A = \frac{R_T}{R_C} \qquad G_A = \frac{G_T}{G_C} \qquad B_A = \frac{B_T}{B_C} \tag{1}$$

where $R_A$, $G_A$, and $B_A$ are the respective adjustment values for each RGB channel at the arbitrary temperature T; $R_T$, $G_T$, and $B_T$ are the respective RGB values interpolated from two RGB sets from the RGB table corresponding to the temperatures T1, T2 that define the smallest temperature interval containing the temperature T; and $R_C$, $G_C$, and $B_C$ are the respective RGB values corresponding to the target color at a stable operating display temperature.

The examples described in connection with FIGS. 10, 11, and 12 are merely illustrative. In general, a table of color-specific adjustment values may be derived for any desired color (i.e., for any desired R:G:B ratio). For example, a table of color-specific adjustment values may be derived for ten different colors (i.e., ten different R:G:B ratios), more than ten different colors, less than ten different colors, etc. The exemplary colors described in connection with FIGS. 10, 11, and 12 are merely illustrative.

If desired, tables of color-specific adjustment values may be derived for display colors that tend to experience more noticeable shifts as display temperature changes. For example, slight changes in skin tone colors may be more noticeable to the human eye than slight changes in other display colors. Tables of adjustment values may be derived for a group of colors (i.e., a group of R:G:B ratios) corresponding to different skin tones. As additional examples, tables of adjustment values may be derived different grass tones, for different sky tones, etc.

The RGB tables described above in connection with FIGS. 10, 11, and 12 may be derived from sets of color gamuts that are constructed during calibration operations. A color gamut may be constructed in a number of ways. The color gamut may represent the range of possible colors that a display may produce for a given temperature.

In one suitable arrangement, the color gamut may be constructed by employing a look-up table based model and the color gamut may be an empirical model. With this type of arrangement, a set of input RGB values may be predetermined. The selection of the set of predetermined RGB values may be based on the number of desired values for each color. For example, six values ranging from 0 to 255 may be chosen for the red component, six values ranging from 0 to 255 may be chosen for the green component and six values ranging from 0 to 255 may be chosen for the blue component. For every combination of the six values for each of the three components, a luminance (Y) and a chromaticity (x,y) may be measured. These measurements may be repeated for a number of different temperatures.

For constructing a color gamut at a temperature T1, for example, measurements corresponding to a color model and at the temperature T1 may be taken. The measurements at each of the temperatures T1 through Tm may show the variation of luminance or the variation of a target color in the form of the correlated color temperature value (as an example).

Returning to constructing a color gamut, a predetermined set of RGB values may be defined. In this example, at each operating temperature T1 through Tm, the luminance (Y) and the chromaticity (x,y) may be measured for each of the RGB values in the predetermined set of RGB values. If the matrix color model is used, four color measurements for pure red, pure green, pure blue and pure white, at each temperature T1, through Tm, may be used for the display. For example, pure red may be produced by input RGB values of 255, 0, 0, pure green may be produced by input RGB values of 0, 255, 0, pure blue may be produced by input RGB values of 0, 0, 255 and pure white may be produced by input RGB values of 255, 255, 255.

If a look-up table model is used with 216 samples (6×6×6=216), the measurements may be taken of luminance (Y) and chromaticity (x,y) for 216 predetermined RGB values. For example, at a temperature T1, a luminance and chromaticity measurement may be taken for each of the 216 predetermined RGB values. Similarly, for a temperature T2, another luminance and chromaticity measurement may be taken for each of the 216 predetermined RGB values and so on. The 216 RGB values is provided for explanatory purposes only. If desired, the number of samples per each component may be increased (for example, using seven or more values for each of the individual RGB values), thus increasing the accuracy of the empirical model.

Each color gamut CG1 through CGm may be defined at each temperature T1 through Tm, respectively. The RGB table may be calculated once the target luminance Y and target chromaticity (x,y) values are set. The calculation of the RGB table may be performed line by line. Each line in the table may correspond to a respective temperature T1 through Tm such that the RGB table has m lines. For each line k in the RGB table, the RGB values may be computed as follows. For temperature Tk, the target luminance and white point values may correspond to a unique color in the color gamut CGk. The unique color may be produced by a certain RGB value, RGBk. Resolving the RGBk color for a given target color and color gamut may depend on the color model that is used for the display. For example, if the matrix model is used, the following equations are used to compute RGB from Yxy of the target:

$$X = \frac{Y}{y}x,$$

$$Z = \frac{Y}{y}(1 - x - y)$$

$$[r_{linear} g_{linear} b_{linear}]^T = M^{-1i}[XYZ]^T$$

$$R = rTRC - 1[r_{linear}]$$

$$G = gTRC - 1[g_{linear}]$$

$$B = bTRC - 1[b_{linear}]$$

where $$M = \begin{bmatrix} X_r & X_g & X_b \\ Y_r & Y_g & Y_b \\ Z_r & Z_g & Z_b \end{bmatrix}$$

wherein rTRC corresponds to the red tone reproduction curve, gTRC corresponds to the green tone reproduction curve, and bTRC corresponds to the blue tone reproduction curve.

If the look-up table model is used, the calculation of the RGB with a defined color gamut as a table of (RGB Yxy) sets may be based on tetrahedral decomposition and tetrahedral interpolation, which are known to one of ordinary skill in the art.

The exemplary operating temperatures for constructing a color model may be selected at intervals sufficiently close together such that the color may be adjusted at small enough temperature intervals that there may be no perceptible shift in color. A color model including a luminance measurement Y and a chromaticity measurement (x,y) for each of the predetermined RGB values may be constructed for each of the set of operating temperatures. For example, at an operating temperature T, a color model generated or used by the present embodiment may include a luminance measurement Y and a chromaticity measurement (x,y) for each predetermined RGB value. For example, a color model may contain the following information:

TABLE 1

| | | | | | |
|---|---|---|---|---|---|
| T1 | R1 | G1 | B1 | Y1 | (x, y)1 |
| T1 | R2 | G2 | B2 | Y2 | (x, y)2 |
| | | | . . . | | |
| T1 | Rn | Gn | Bn | Yn | (x, y)n |

where the measurements (Yxy)1 through (Yxy)n correspond to the temperature T1. Accordingly, multiple luminance and chromaticity values (Y and (x,y), respectively) may be measured for a variety of predetermined RGB values R1,G1,B1 to Rn,Gn,Bn at a single operating temperature T1. Also, n is the number of luminance and chromaticity measurements taken at each operating temperature.

For every selected operating temperature T1 through Tm, color gamuts CG1 through CGm may be constructed for each corresponding temperature. The construction of the color gamuts may be based on the color model that employs the measurements at each temperature T1 through Tm. The measurements taken at each of the temperatures T1 through Tm may be selected to cover the range from approximately the cold start-up temperature of the display to the stable operating temperature of the display. In one example, the last or stable operating temperature may be the display temperature after the display has been on for a predetermined period of time. Generally, the color table for the last temperature may be represented as:

TABLE 2

| | | | | | |
|---|---|---|---|---|---|
| Tm | R1 | G1 | B1 | Y1 | (x, y)1 |
| Tm | R2 | G2 | B2 | Y2 | (x, y)2 |
| | | | . . . | | |
| Tm | Rn | Gn | Bn | Yn | (x, y)n |

Thus, m color gamuts CG1 through CGm may be constructed using the temperatures, predetermined RGB values, luminance measurements and chromaticity measurements and the color model at each temperature T1 through Tm. The m color models may, for example, take the form of tables 1 and 2, where table 1 corresponds to color model 1 and where table 2 corresponds to color model m.

In another suitable embodiment, a color model may be constructed using a matrix model. The matrix model may, for example, employ measurements of the following colors: the display red, green, blue and white colors, and a set of intermediate gray colors between black and white for tone reproduction curve estimation. For this embodiment, 6 intermediate gray colors may be used. The luminance measurements Y and the chromaticity measurements (x,y) may be taken for a predetermined set of RGB values specified by the following n=4+6 combinations, and the (Yxy)j,k may represent the measurements for the color model k at temperature Tk, k=1 through m and for the combination j, where j may be a natural number from n=1 through n=10.

Color Model 1

TABLE 3

| | | | | | |
|---|---|---|---|---|---|
| T1 | 255 | 0 | 0 | Y1, 1 | (x, y)1, 1 |
| T1 | 0 | 255 | 0 | Y2, 1 | (x, y)2, 1 |
| T1 | 0 | 0 | 255 | Y3, 1 | (x, y)3, 1 |
| T1 | 255 | 255 | 255 | Y4, 1 | (x, y)4, 1 |
| T1 | 204 | 204 | 204 | Y5, 1 | (x, y)5, 1 |
| T1 | 153 | 153 | 153 | Y6, 1 | (x, y)6, 1 |
| | | | . . . | | |
| T1 | 0 | 0 | 0 | Y10, 1 | (x, y)10, 1 |

Color Model m

TABLE 4

| | | | | | |
|---|---|---|---|---|---|
| Tm | 255 | 0 | 0 | Y1, m | (x, y)1, m |
| Tm | 0 | 255 | 0 | Y2, m | (x, y)2, m |
| Tm | 0 | 0 | 255 | Y3, m | (x, y)3, m |
| Tm | 255 | 255 | 255 | Y4, m | (x, y)4, m |
| Tm | 204 | 204 | 204 | Y5, m | (x, y)5, m |
| Tm | 153 | 153 | 153 | Y6, m | (x, y)6, m |
| | | | . . . | | |
| Tm | 0 | 0 | 0 | Y10, m | (x, y)10, m |

The tone reproduction curve in the matrix model may be determined at each temperature T1 through Tm from the measurements Y5, k through Y10, k using an interpolation method familiar to one of ordinary skill in the art. In this embodiment, linear interpolation may be employed (if desired).

In another embodiment, a color model may be constructed using a matrix model where the tone reproduction curves may be independent of the temperature and estimated before the color measurements are taken at the temperature T1 through Tm. The measurement of the intermediate gray colors may be done at the initial cold or warmed up stable display temperature. The curves may be derived through interpolation one time and may be used for each color model at temperature T1 through Tm. For this embodiment, the matrix model may employ the measurements of the following colors: the device red, green, blue and white colors. The luminance measurements Y and the chromaticity measurements (x,y) may be taken for a predetermined set of RGB values specified by the following n=4 combinations. Additionally, the (Yxy)j,k values may represent the measurement for the color model k at temperature Tk, k=1 through m and for the combination j, where j may be a natural number from 1 through n=10.

Color Model 1

TABLE 5

| | | | | | |
|---|---|---|---|---|---|
| T1 | 255 | 0 | 0 | Y1, 1 | (x, y)1, 1 |
| T1 | 0 | 255 | 0 | Y2, 1 | (x, y)2, 1 |
| T1 | 0 | 0 | 255 | Y3, 1 | (x, y)3, 1 |
| T1 | 255 | 255 | 255 | Y4, 1 | (x, y)4, 1 |

Color Model m

TABLE 6

| | | | | | |
|---|---|---|---|---|---|
| Tm | 255 | 0 | 0 | Y1, m | (x, y)1, m |
| Tm | 0 | 255 | 0 | Y2, m | (x, y)2, m |
| Tm | 0 | 0 | 255 | Y3, m | (x, y)3, m |
| Tm | 255 | 255 | 255 | Y4, m | (x, y)4, m |

In another embodiment, a color model may be constructed using a look-up table model. The luminance measurements Y and the chromaticity measurements (x,y) may be taken for a predetermined set of RGB values specified by the following n=6×6×6 combinations. Six intermediate values may be set for each R,G,B component, and the (Yxy)j,k may represent the measurement for the color model k at temperature Tk, k=1 through m and for the combination j, where j may be a natural number from 1 through n=216.

Color Model 1

TABLE 7

| | | | | | |
|---|---|---|---|---|---|
| T1 | 255 | 255 | 255 | Y1, 1 | (x, y)1, 1 |
| T1 | 255 | 255 | 204 | Y2, 1 | (x, y)2, 1 |
| T1 | 255 | 255 | 153 | Y3, 1 | (x, y)3, 1 |
| T1 | 255 | 255 | 102 | Y4, 1 | (x, y)4, 1 |
| | | | . . . | | |
| T1 | 0 | 0 | 0 | Y216, 1 | (x, y)216, 1 |

Color Model m

TABLE 8

| | | | | | |
|---|---|---|---|---|---|
| Tm | 255 | 255 | 255 | Y1, m | (x, y)1, m |
| Tm | 255 | 255 | 204 | Y2, m | (x, y)2, m |

TABLE 8-continued

| | | | | | |
|---|---|---|---|---|---|
| Tm | 255 | 255 | 153 | Y3, m | (x, y)3, m |
| Tm | 255 | 255 | 102 | Y4, m | (x, y)4, m |
| | | | ... | | |
| Tm | 0 | 0 | 0 | Y216, m | (x, y)216, m |

If desired, a color-specific color model may be constructed for each target color. For example, color models for yellowish (R:G:B=2:2:1) may be constructed by taking luminance measurements Y and chromaticity measurements (x,y) for a predetermined set of RGB values having R:G:B ratios of 2:2:1. The m color models for yellowish colors may, for example, take the following form:

Color Model 1

TABLE 9

| | | | | | |
|---|---|---|---|---|---|
| T1 | 255 | 255 | 127 | Y1, 1 | (x, y)1, 1 |
| T1 | 221 | 221 | 110 | Y2, 1 | (x, y)2, 1 |
| T1 | 187 | 187 | 93 | Y3, 1 | (x, y)3, 1 |
| | | | ... | | |
| T1 | 17 | 17 | 6 | Y8, 1 | (x, y)8, 1 |

Color Model m

TABLE 10

| | | | | | |
|---|---|---|---|---|---|
| Tm | 255 | 255 | 127 | Y1, m | (x, y)1, m |
| Tm | 221 | 221 | 110 | Y2, m | (x, y)2, m |
| Tm | 187 | 187 | 93 | Y3, m | (x, y)3, m |
| | | | ... | | |
| Tm | 17 | 17 | 8 | Y8, m | (x, y)8, m |

Color models of the type shown in tables 9 and 10 may be constructed for any desired color (i.e., any suitable R:G:B ratio). In general, any suitable color model may be used to determine adjustment values for a given color. If desired, the color model that is used to determine adjustment values for a given color may be chosen based on which color model offers the most accurate compensation for changes in display temperature.

Moreover, the color models may be a function of multiple input parameters, as opposed to a function of temperature alone. The RGB values, luminance values and chromaticity values may be recorded for multiple input parameters. For example, RGB values may be recorded for combinations of input parameters such as brightness and temperature. Further, the RGB values, luminance values and chromaticity values may be recorded at multiple temperatures at a first brightness level, a second brightness level and so on. Similar to previously discussed methods, the RGB values may be used to determine adjustment values such as attenuation factors. Additionally, interpolation may be used to determine adjustment values for any combination of input parameters and by employing the previously recorded RGB values, luminance values, chromaticity values for the various combinations of input parameters.

As the RGB adjustment value table includes a finite number of entries, it may occur that the actual operating temperature of a display falls between temperatures for which entries exist in the RGB adjustment value table. Certain embodiments may use the existing entries of the RGB adjustment value table to interpolate adjustment values for such interim temperatures. The adjustment values corresponding to the interim temperature may be interpolated based on the adjustment values of the entries in the table bounding the interim temperature (e.g., the adjustment values for the nearest temperature above the current operating temperature and the nearest temperature below the current operating temperature).

Certain embodiments use linear interpolation to calculate the adjustment value for the interim temperature, while others may use a different form of interpolation. Any known form of interpolation may be employed by various embodiments. Accordingly, RGB values may be determined for display temperatures that are not included in the existing RGB table. Moreover, it may be possible to increase the granularity of the temperatures and corresponding RGB values by interpolating between the existing RGB values and determining additional RGB values for temperatures not originally included in the RGB table. In another embodiment, previous adjustment values may be used to determine a trend and/or a slope of change in adjustment values to more accurately interpolate the next value.

Although the RGB values, luminance measurements and chromaticity measurements have been discussed herein as a function of temperature, alternative embodiments may adjust the color output of a display based on other parameters. For example, the RGB values, luminance and chromaticity may be sampled as a function of other parameters including, but not limited to, time, brightness settings, the age of the display or any combination thereof. Accordingly, the RGB table and adjustment constants generated or employed by an embodiment would account for such parameters.

Figure 13:
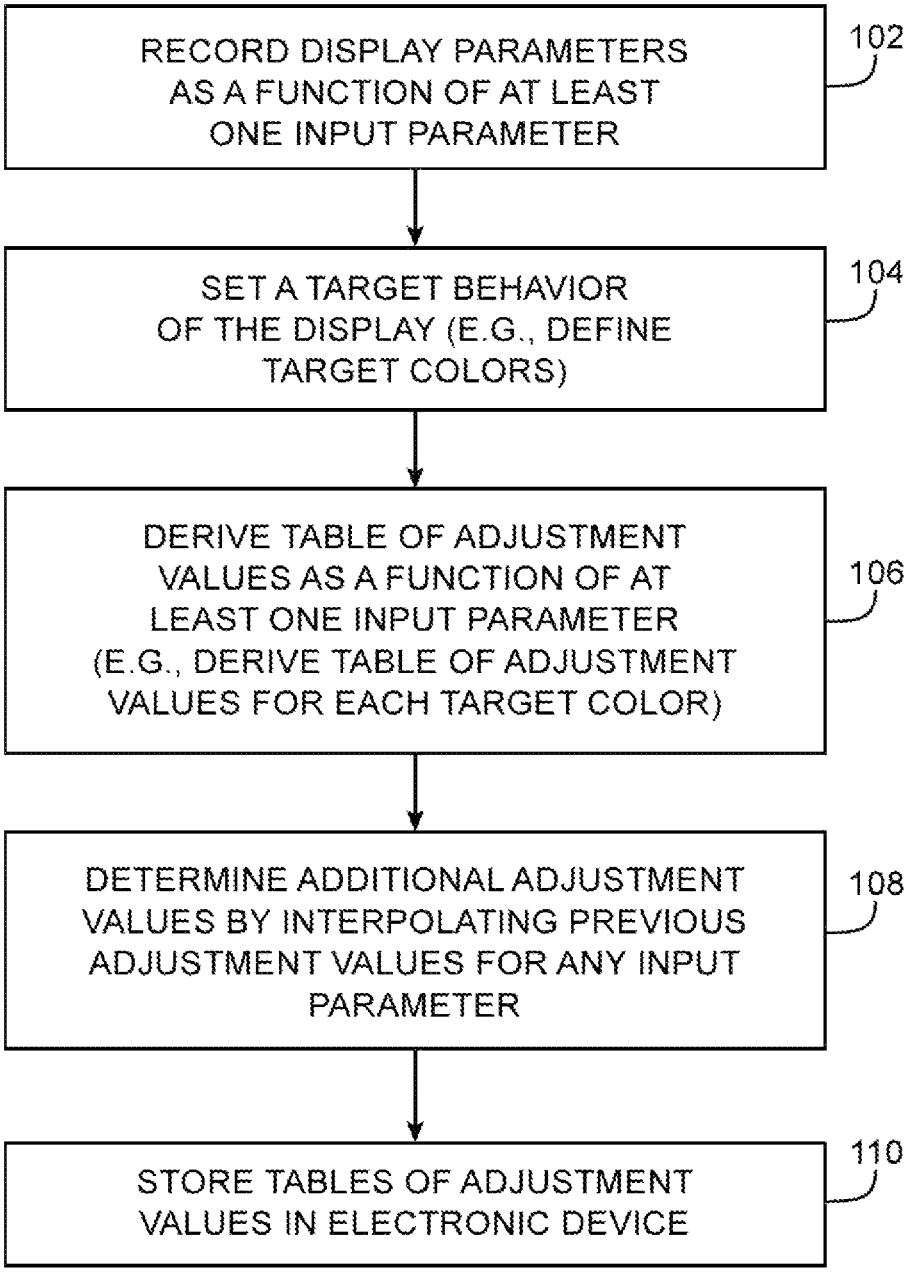
FIG. 13 is a flow chart of illustrative steps involved in obtaining tables of adjustment factors for multiple colors in accordance with an embodiment of the present invention.

FIG. 13 is a flow chart of illustrative steps involved in calibrating a display such as display 14.

At step 102, a calibration system such as calibration system 48 of FIG. 9 may be used to gather display performance data from display 14. For example, light sensor 40 may be used to gather one or more images of display 14 while display 14 is operated in a series of calibration sequences. This may include, for example, measuring luminance values Y and chromaticity values (x,y) while pixels 52 are operated at different intensity levels (e.g., while different RGB input values are provided to display pixel 52). The luminance values Y and chromaticity values (x,y) may be recorded as a function of at least one parameter or a combination of parameters. The parameters may be temperature, time, brightness, ambient light, the aging of the display, or any combination thereof. Temperature information such as display temperature may be provided to calibration computing equipment 46 using a thermal sensor in device 10 such as temperature sensor 60.

Additionally, other data values may be recorded (and thus adjusted) such as contrast, tone reproduction curves, or any other visual parameter of the display. The luminance and chromaticity values may be recorded over a time period such as the warming up time of a display. The intervals that the luminance and chromaticity values are recorded may vary. Generally, the intervals may be selected such that when the color of the display is adjusted, it may not be perceptible to a user.

At step 104, a target behavior of the display may be defined. This may include, for example, setting a target color (e.g., target luminance and chromaticity values) for each color in a predetermined set of colors. For example, target colors may be may be set respectively for white, for yellowish, for greenish blue, for redish blue, for greenish red, etc. Target colors may, if desired, be set for high-importance colors such as skin tone colors, grass tone colors, and sky tone colors.

At step 106, calibration computing equipment 46 may use the gathered display performance data such as the measured luminance and chromaticity values to calculate adjustment values as a function of the at least one input parameter. The adjustment values may be organized into RGB adjustment value tables. A table of adjustment values may be derived for each color in the predetermined set of colors. As previously discussed, the adjustment values may be attenuation factors for the RGB channels in display 14.

At step 108, additional adjustment values may be determined by interpolating from the temperatures and adjustment values in the RGB adjustment value tables. By employing interpolation to determine these additional adjustment values, it may be possible to determine adjustment values for any temperature. The additional adjustment values may be stored in the RGB adjustment value table.

At step 110, the RGB adjustment value tables may be stored in device 10. If desired, the RGB adjustment value tables may be stored in display control circuitry 28 in device 10 or may be stored in any other suitable location in device 10 such as storage and processing circuitry 34.

Figure 14:
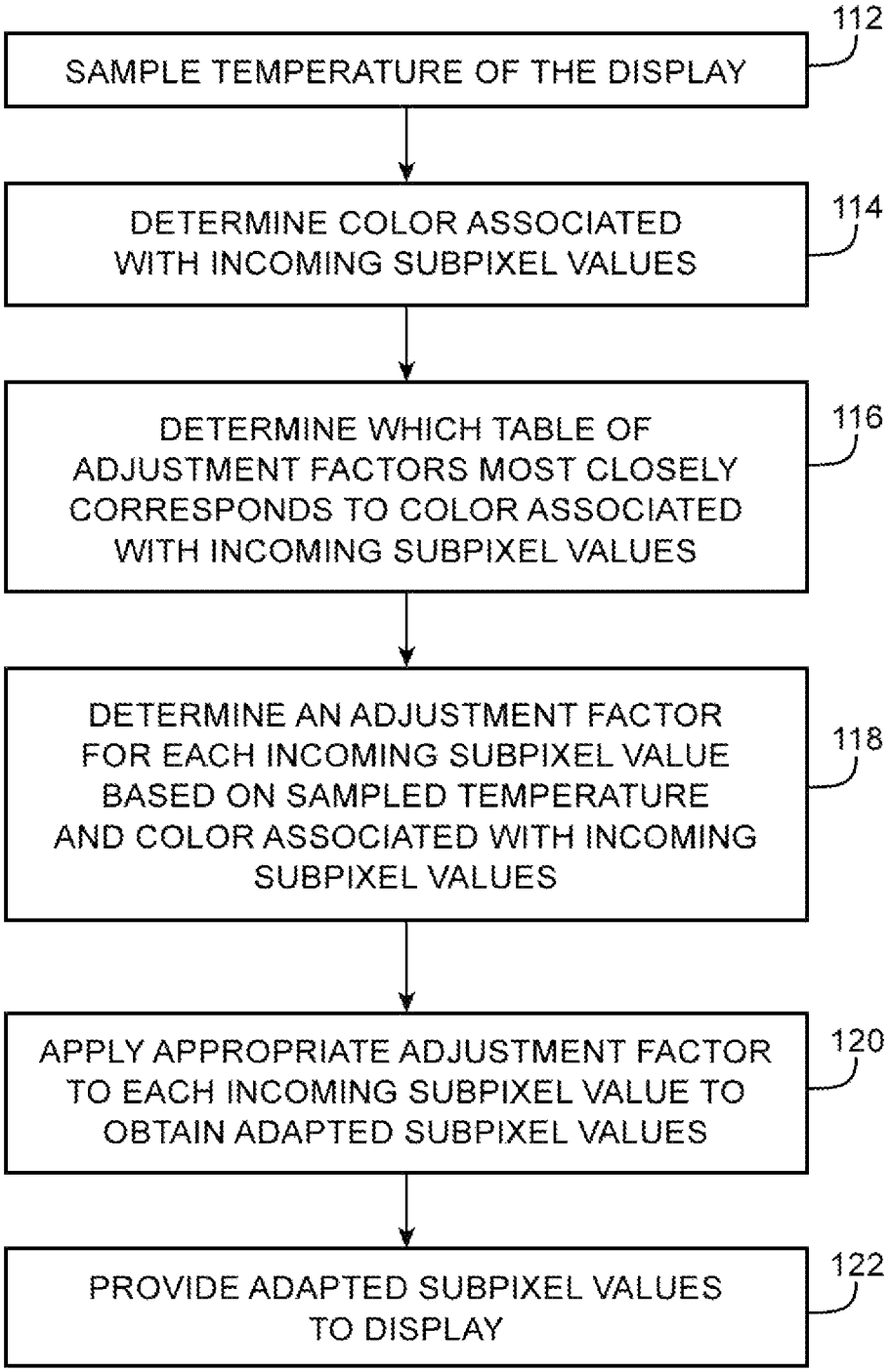
FIG. 14 is a flow chart of illustrative steps involved in performing display color correction using color-specific and temperature-dependent adjustment factors in accordance with an embodiment of the present invention.

FIG. 14 is a flow chart of illustrative steps involved in adjusting display colors during operation of display 14 to minimize undesirable color shifts as the display temperature changes.

At step 112, display control circuitry 28 may receive temperature information such as display temperature from a thermal sensor in device 10 such as temperature sensor 60.

At step 114, display control circuitry 28 may receive incoming RGB subpixel values (which may sometimes be referred to as input RGB values, data, display data, digital display control values, or display control signals) and may determine the color associated with the incoming RGB values. If desired, display control circuitry 28 may optionally linearize the incoming subpixel values to remove display gamma non-linearity (e.g., if the display gamma is not equal to one). If the display gamma is equal to one, the step of linearizing the incoming RGB values may be omitted.

Step 114 may include, for example, determining the R:G:B ratio associated with the incoming RGB values. For example, display control circuitry 28 may determine that the R:G:B ratio of incoming RGB values is 2:2:1 and may therefore determine that the color associated with the incoming RGB values is yellowish. As another example, step 114 may include determining that the color associated with incoming RGB values is a skin tone color.

At step 116, display control circuitry 28 may determine which RGB adjustment value table most closely corresponds to the color associated with the incoming RGB values. If the color associated with the incoming RGB values does not exactly match one of the colors for which adjustment values have been stored, interpolation techniques may be used to determine an appropriate set of adjustment values based on the color associated with the incoming RGB values. For example, a combination of Inverse Distance Weighting and Delaunay Triangulation may be used to interpolate RGB adjustment values for the incoming RGB values.

At step 118, display control circuitry 28 may determine an adjustment value for the incoming RGB values based on the sampled display temperature and the color associated with the incoming RGB values. If the display operating temperature falls between temperatures for which entries exist in the RGB adjustment value table, the existing entries in the RGB adjustment value table may be used to interpolate adjustment values for the actual display temperature.

At step 120, display control circuitry 28 may apply the appropriate adjustment value to each incoming RGB subpixel value to obtain adapted RGB subpixel values. This may include, for example, multiplying the display input value for red by a red correction coefficient, multiplying the display input value for green by a green correction coefficient, and multiplying the display input value for blue by a blue correction coefficient.

The resulting adapted linearized subpixel values may then optionally be de-linearized (e.g., to restore the non-linear display gamma) to obtain adapted subpixel vales R', G', and B'. The adapted RGB values may then be supplied to pixels 52 in display 14.

Figure 15:
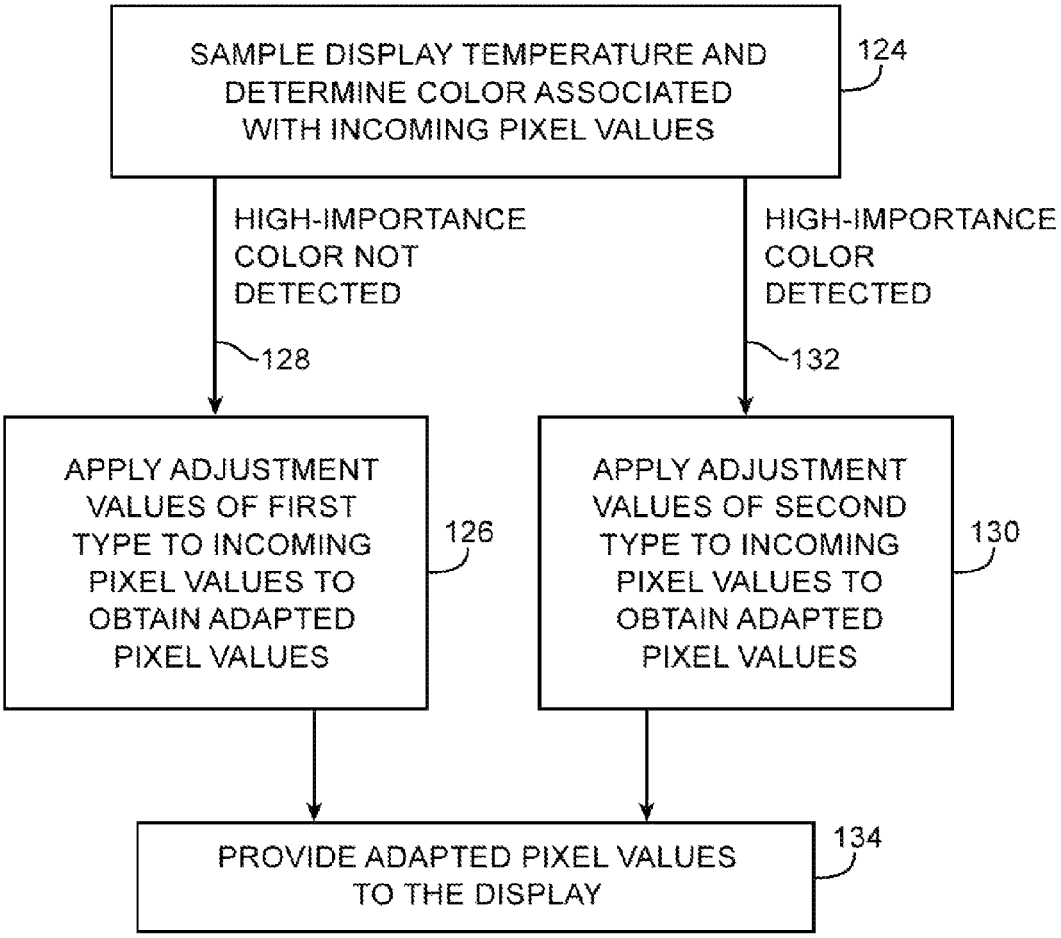
FIG. 15 is a flow chart of illustrative steps involved in performing display color correction using first and second types of temperature-dependent adjustment factors in accordance with an embodiment of the present invention.

FIG. 15 is a flow chart of illustrative steps involved in adjusting display colors during operation of display 14 based on which colors exhibit perceivable changes as the display temperature changes.

At step 124, display control circuitry 28 may sample the temperature of display 14 using a thermal sensor such as temperature sensor 60. Display control circuitry 28 may also determine the color associated with incoming RGB values. This may include, for example, determining the R:G:B ratio associated with the incoming RGB values.

If it is determined that the color associated with incoming RGB values is not a high-importance color, processing may proceed to step 126, as indicated by line 128. As described in connection with FIG. 8, a high-importance color may be a color for which maintaining display color integrity is of particular importance. High-importance colors may include skin tone colors, grass tone colors, sky tone colors, and other high-importance colors. Display control circuitry 28 may determine whether the color associated with incoming RGB values is a high-importance color by determining whether the color falls within a predetermined region of high-importance colors in a color space (e.g., regions such as regions 51, 53, and 55 of a color space as shown in FIG. 8).

At step 126, display control circuitry 28 may apply adjustment values of a first type to the incoming RGB values to obtain adapted RGB values. The adjustment values applied to the incoming RGB values may be determined based on the display temperature sampled during step 124. The adjustment values of the first type may, for example, be optimized for neutral colors such as white and gray.

If it is determined that the color associated with the incoming RGB values is a high-importance color (e.g., a skin tone color, a grass tone color, a sky tone color, or other high-value color), processing may proceed to step 130, as indicated by line 132. Display control circuitry 28 may determine that the color associated with incoming RGB values is a high-importance color by determining that the color falls within a predetermined region of high-importance colors in a color space (e.g., regions such as regions 51, 53, and 55 of a color space as shown in FIG. 8).

At step 130, display control circuitry 28 may apply adjustment values of a second type to the incoming RGB values to obtain adapted RGB values. The adjustment values applied to the incoming RGB values may be determined based on the display temperature sampled during step 124. The adjustment values of the second type may be optimized for different high-importance colors. For example, one or more tables of adjustment values of the second type may be optimized for skin tone colors, one or more tables of adjustment values of the second type may be optimized for grass tone colors, and one or more tables of adjustment values of the second type may be optimized for sky tone colors. These examples are merely illustrative. In general, any subregion of a color space may be defined as a region of high-importance colors.

Display control circuitry 28 may determine which table of adjustment values to use based on the color associated with the incoming RGB values. For example, if the color falls within region 51 of the color space of FIG. 8, control circuitry 28 may use adjustment values that are optimized for skin tone colors. If the color falls within region 53 of the color space of FIG. 8, control circuitry 28 may use adjustment values that are optimized for grass tone colors. If the color falls within region 55 of the color space of FIG. 8, control circuitry 28 may use adjustment values that are optimized for sky tone colors (as examples).

The foregoing is merely illustrative of the principles of this invention and various modifications can be made by those skilled in the art without departing from the scope and spirit of the invention. The foregoing embodiments may be implemented individually or in any combination.

What is claimed is:

1. A method for displaying data on a display that has an array of display pixels, wherein the display has display control circuitry that supplies the data to each of the display pixels using a plurality of look-up tables and wherein each of the look-up tables corresponds to a respective color in a plurality of colors, the method comprising:

for at least one display pixel in the display, using the display control circuitry to:

receive temperature information from a thermal sensor;

determine a color associated with incoming pixel values;

determine adjustment values based on the temperature information and the color, wherein the adjustment values are stored in one of the look-up tables corresponding to a given color;

apply the adjustment values to the incoming pixel values to obtain adapted pixel values; and supply the adapted pixel values to the display pixel to display the data.

2. The method defined in claim 1 wherein determining the adjustment values comprises determining that the color associated with the incoming pixels corresponds to the given color associated with the look-up table.

3. The method defined in claim 1 wherein the temperature information comprises a display temperature, wherein the adjustment values correspond to a given temperature, and wherein determining the adjustment values comprises determining that the display temperature corresponds to the given temperature.

4. The method defined in claim 1 wherein the at least one display pixel comprises a red subpixel, a green subpixel, and a blue subpixel, and wherein determining adjustment values comprises determining a red adjustment value for the red subpixel, a green adjustment value for the green subpixel, and a blue adjustment value for the blue pixel.

5. The method defined in claim 1, wherein the incoming pixel values comprise a red value, a green value, and a blue value and wherein determining the color associated with the incoming pixel values comprises determining a ratio of the red value to the green value to the blue value.

6. The method defined in claim 1, further comprising:

prior to determining the color associated with the incoming pixel values, linearizing the incoming pixel values.

7. The method defined in claim 6, further comprising:

prior to supplying the adapted pixel values to the display pixel, delinearizing the adapted pixel values.

8. A method for obtaining display calibration information for an electronic device having a display, comprising:

with calibration computing equipment, gathering temperature information and display performance information from the electronic device; and with the calibration computing equipment, deriving a plurality of tables of adjustment values based on the temperature information and the display performance information, wherein each of the tables of adjustment values corresponds to a respective color in a plurality of colors.

9. The method defined in claim 8 wherein gathering the display performance information comprises:

with a light sensor, capturing a plurality of images of the display while the display is operated in a plurality of different modes of operation.

10. The method defined in claim 8 wherein gathering display performance information comprises measuring display luminance and chromaticity.

11. The method defined in claim 8 wherein deriving the plurality of tables of adjustment values comprises deriving, for each temperature in a plurality of temperatures, a red attenuation factor for a red channel in the display, a green attenuation factor for a green channel in the display, and a blue attenuation factor for a blue channel in the display.

12. A method for displaying data on a display that has an array of display pixels, wherein the display has display control circuitry that supplies the data to each of the display pixels using a plurality of look-up tables and wherein each of the look-up tables corresponds to a respective color in a plurality of colors, the method comprising:

for at least one display pixel in the display, using the display control circuitry to:

receive temperature information from a thermal sensor;

determine whether a color associated with incoming pixel values falls within a predetermined subset of colors;

apply adjustment values to the incoming pixel values based on the color and the temperature information to obtain adapted pixel values, wherein the adjustment values are stored in one of the look-up tables corresponding to a given color; and provide the adapted pixel values to the display pixels.

13. The method defined in claim 12 wherein the predetermined subset of a colors is a subset of colors selected from the group consisting of: a subset of skin tone colors, a subset of grass tone colors, and a subset of sky tone colors.

14. The method defined in claim 12 wherein the adjustment values comprise adjustment values of a first type and a second type, the method further comprising:

when it is determined that the color associated with the incoming pixel values does not fall within the predetermined subset of colors, applying the adjustment values of the first type to the incoming pixel values; and when it is determined that the color associated with the incoming pixel values is within the predetermined subset of colors, applying the adjustment values of the second type to the incoming pixel values.

15. The method defined in claim 14 wherein the adjustment values of the first type are values that compensate for temperature-related white point shifts and wherein applying the adjustment values of the first type to the incoming pixel values comprises applying a red adjustment value to a red pixel value, a green adjustment value to a green pixel value, and a blue adjustment value to a blue pixel value.

16. The method defined in claim 14 wherein the adjustment values of the second type are values that compensate for temperature-related shifts in the predetermined subset of colors and wherein applying the adjustment values of the second type to the incoming pixel values comprises applying a red adjustment value to a red pixel value, a green adjustment value to a green pixel value, and a blue adjustment value to a blue pixel value.

17. The method defined in claim 12 wherein the temperature information comprises a display temperature, the method further comprising:

determining the adjustment values to apply to the incoming pixel values based on the display temperature.

18. An electronic device, comprising:

a display having an array of display pixels;

a thermal sensor configured to generate temperature information;

storage and processing circuitry configured to generate input pixel values for the display pixels, wherein each input pixel value is associated with a color to be displayed by a given pixel in the array of display pixels, wherein the storage and processing circuitry stores a plurality of look-up tables, and wherein each of the look-up tables corresponds to a respective color in a plurality of colors; and display control circuitry configured to apply adjustment factors to each input pixel value based on the color and the temperature information, wherein the adjustment factors are stored in one of the look-up tables corresponding to a given color.

19. The electronic device defined in claim 18 wherein the display control circuitry comprises a display timing controller integrated circuit.

20. The electronic device defined in claim 18 wherein the display control circuitry comprises a graphics controller.

21. The electronic device defined in claim 18 wherein each of the adjustment factors comprises a value between 0 and 1.

22. The electronic device defined in claim 18 wherein the temperature information comprises a display operating temperature.

* * * * *

UNITED STATES PATENT AND TRADEMARK OFFICE

CERTIFICATE OF CORRECTION

PATENT NO. : 8,970,468 B2
APPLICATION NO. : 13/683523
DATED : March 3, 2015
INVENTOR(S) : Marc Albrecht et al.

It is certified that error appears in the above-identified patent and that said Letters Patent is hereby corrected as shown below:

In the Claims

In claim 13, column 22, line 39, delete "subset of a colors is a subset of colors" and insert --subset of colors is a subset of colors--.

Signed and Sealed this
Fourth Day of August, 2015

Michelle K. Lee

Michelle K. Lee
*Director of the United States Patent and Trademark Office*